United States Patent [19]

Shinohara

[11] Patent Number: 4,602,546

[45] Date of Patent: Jul. 29, 1986

[54] AUTOMATIC MUSIC PLAYING APPARATUS

[75] Inventor: Isao Shinohara, Kokubunji, Japan

[73] Assignee: Casio Computer Co., Ltd., Tokyo, Japan

[21] Appl. No.: 745,364

[22] Filed: Jun. 14, 1985

Related U.S. Application Data

[63] Continuation of Ser. No. 562,419, Dec. 16, 1983.

[30] Foreign Application Priority Data

Dec. 24, 1982 [JP] Japan ..... 57-226227

[51] Int. Cl.[4] ..... G10H 1/00

[52] U.S. Cl. ..... 84/1.03; 84/1.24

[58] Field of Search ..... 84/1.03, 1.01, 1.24, 84/1.28

[56] References Cited

U.S. PATENT DOCUMENTS

| | | | |
|---|---|---|---|
| 4,090,349 | 5/1978 | Takase . | |
| 4,164,020 | 8/1979 | Griffith . | |
| 4,263,828 | 4/1981 | Aoki et al. . | |
| 4,417,494 | 11/1983 | Nakada et al. | 84/1.19 |
| 4,448,104 | 5/1984 | Hoshii | 84/1.28 |
| 4,466,324 | 8/1984 | Okamoto et al. | 84/1.19 |
| 4,491,049 | 1/1985 | Mizuta et al. | 340/384 E |

FOREIGN PATENT DOCUMENTS

| | | |
|---|---|---|
| 3137284 | 6/1982 | Fed. Rep. of Germany . |
| 3150799 | 8/1982 | Fed. Rep. of Germany . |

OTHER PUBLICATIONS

Isen, "An Electronic Music Synthesizer Controlled by Digital Logic" Aug. 1978, pp. Title, ii, 4,5,8,14,16–20, and 28.

*Primary Examiner*—Forester W. Isen

*Attorney, Agent, or Firm*—Frishauf, Holtz, Goodman & Woodward

[57] ABSTRACT

Melody information representing pitches and durations of tones is stored in a first area of a RAM whose addresses are designated by a first address counter of an address register. Performance information representing tone colors, vibrato, etc. is stored in a second area of the RAM whose addresses are designated by a second address counter of the address register, while the stored melody information is read out and reproduced. The melody information and performance information stored in the respective areas of the RAM are read out in associated relation with respect to one another, to be sounded from loudspeakers.

10 Claims, 18 Drawing Figures

FIG. 6A-I
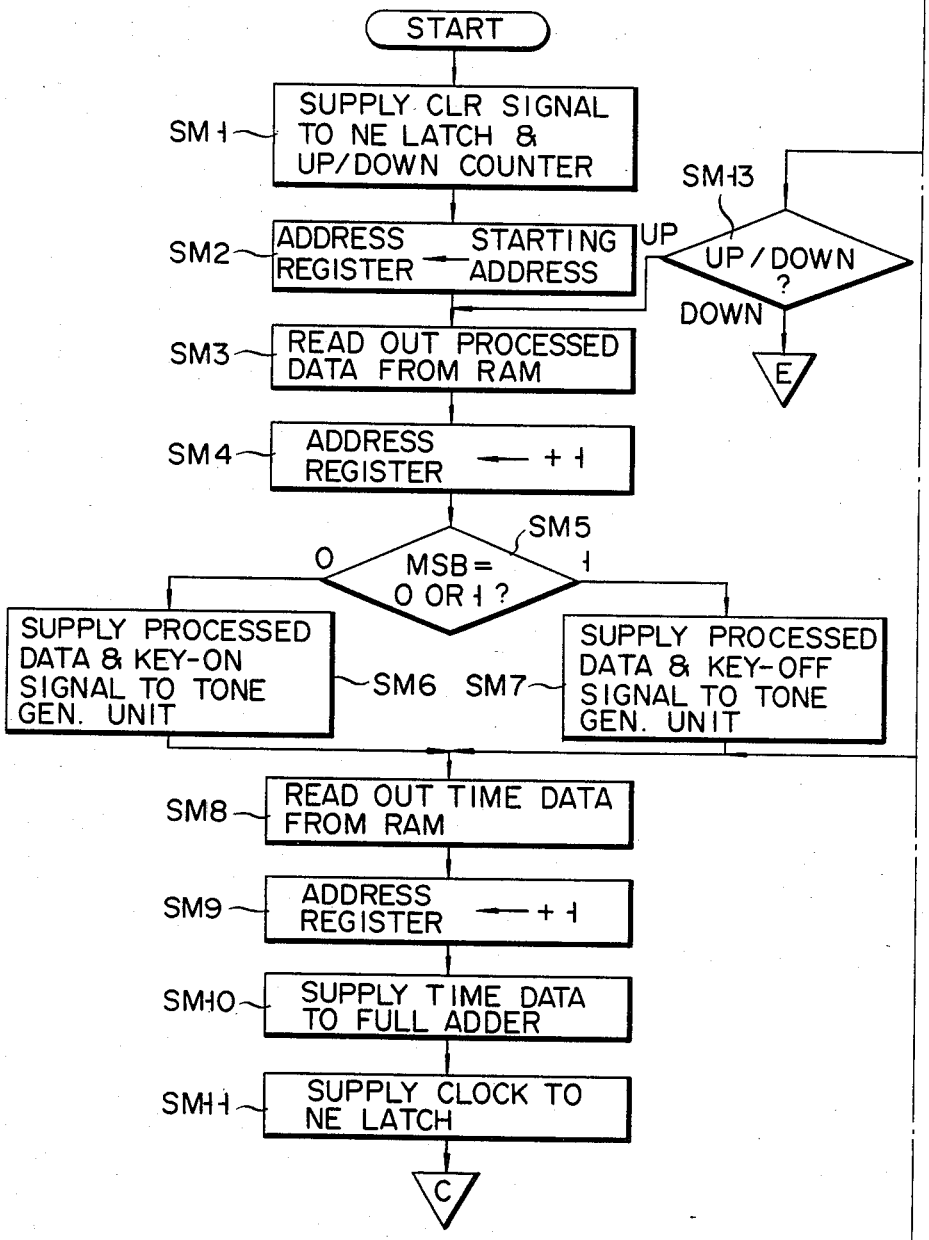

FIG. 6A-II
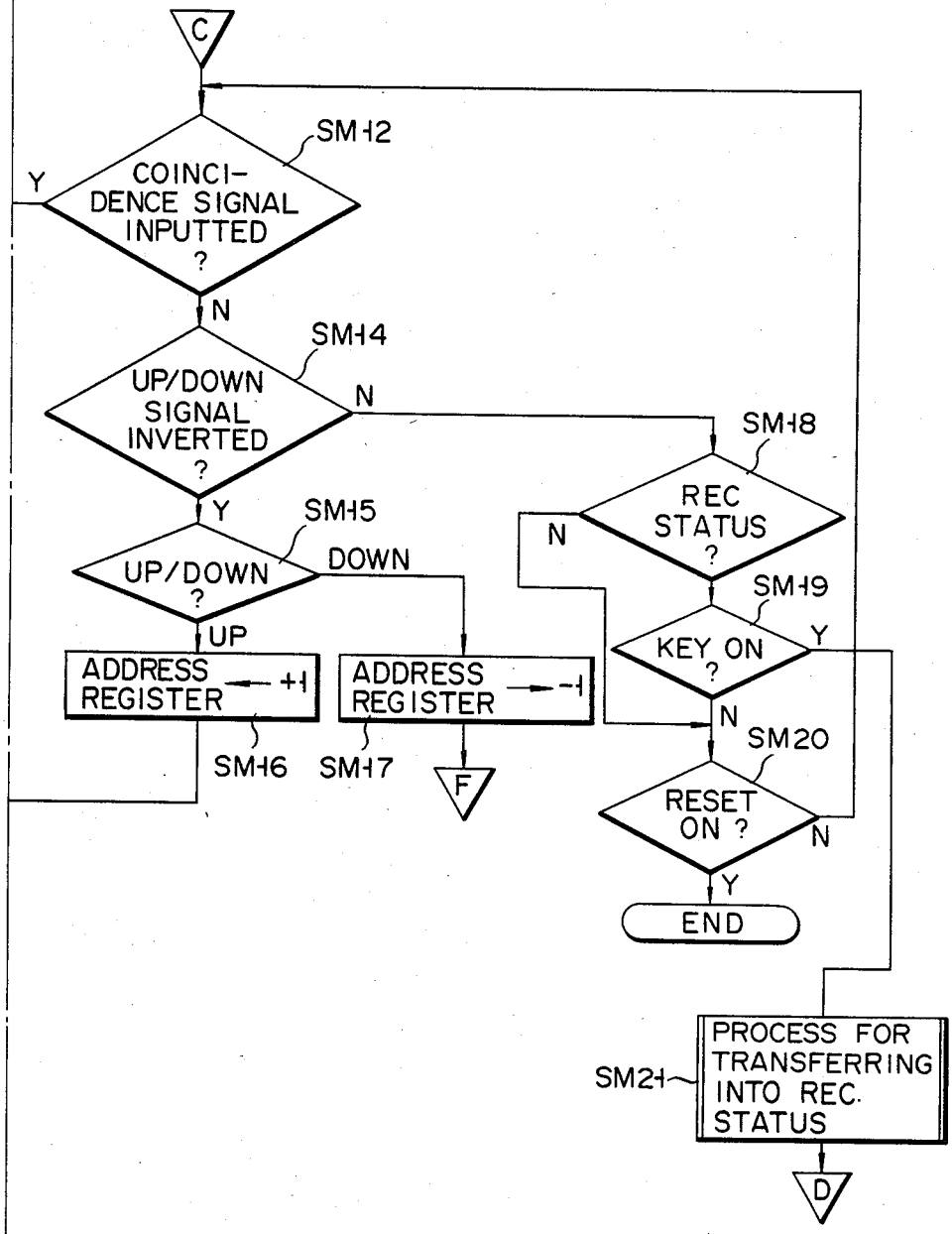

| | |
|---|---|
| TONE 0 | 01H |
| TONE 1 | 02H |
| TONE 2 | 03H |
| TONE 3 | 04H |
| TONE 4 | 05H |
| TONE 5 | 06H |
| TONE 6 | 07H |
| TONE 7 | 08H |
| TONE 8 | 09H |
| TONE 9 | 0AH |

FIG. 9

| | |
|---|---|
| SUSTAIN ON | 1DH |
| SUSTAIN OFF | 9DH |
| VIBRATO ON | 1EH |
| VIBRATO OFF | 9EH |
| DELAY VIB. ON | 1FH |
| DELAY VIB. OFF | 9FH |

FIG. 10

| | |
|---|---|
| RIGHT | 7BH |
| | 7AH |
| | 79H |
| CENTER | 78H |
| | 77H |
| | 76H |
| LEFT | 75H |

FIG. 11

| | |
|---|---|
| FILL IN ON | 1BH |
| FILL IN OFF | 9BH |

AUTOMATIC MUSIC PLAYING APPARATUS

This is a continuation of application Ser. No. 562,419 filed Dec. 16, 1983.

BACKGROUND OF THE INVENTION

This invention relates to an automatic music playing apparatus or a playerless musical instrument, in which tone information indicative of pitches, tone durations, rests, etc. and performance information indicative of tone colors, volume, vibrato, sustain, etc. are stored and read out for playing music automatically.

Prior art automatic music playing apparatus have memories, in which tone information indicative of pitches, tone durations, rests, etc, and performance information indicative of tone color, volume, vibrato, sustain and other effects with respect to the tone information are stored by operating a keyboard and switches. Such tone information and performance information are successively read out for playing music automatically. When writing such information in memory prior to causing automatic playing, data indicative of the pitch, tone duration, rest, tone color, volume, vibrato, sustain, etc. of successive tones of music are input one by one in the order in which they appear in the music score.

However, such input operation is very cumbersome. Particularly, it is possible that the input performance information such as tone color, volume, vibrato fails to match the image of the piece of music because it is difficult to grasp the whole image of the piece when the information is input.

SUMMARY OF THE INVENTION

An object of the invention is to provide an automatic music playing apparatus, which permits input of tone information and performance information in a simple operation and also permits readily grasping the whole image of a piece of music when inputting information, so that automatic playing of music with musical effects suited to the image of the music can be obtained.

According to the invention, there is provided an automatic music playing apparatus, which comprises means for reading tone information stored in first memory means to play automatically music according to the read-out tone information, and setting means for setting performance information with respect to the tone information in second memory means while the automatic playing means is playing music according to the tone information.

BRIEF DESCRIPTION OF THE DRAWING

FIGS. 6A and 6B are flow charts illustrating a process of reproducing the tone information;

FIG. 9 is a view showing various performance effects and corresponding set data;

FIG. 10 is a view showing pan-pot data and corresponding set data;

FIG. 11 is a view showing fill-in set data;

DETAILED DESCRIPTION OF THE PREFERRED EMBODIMENT

Figure 1:
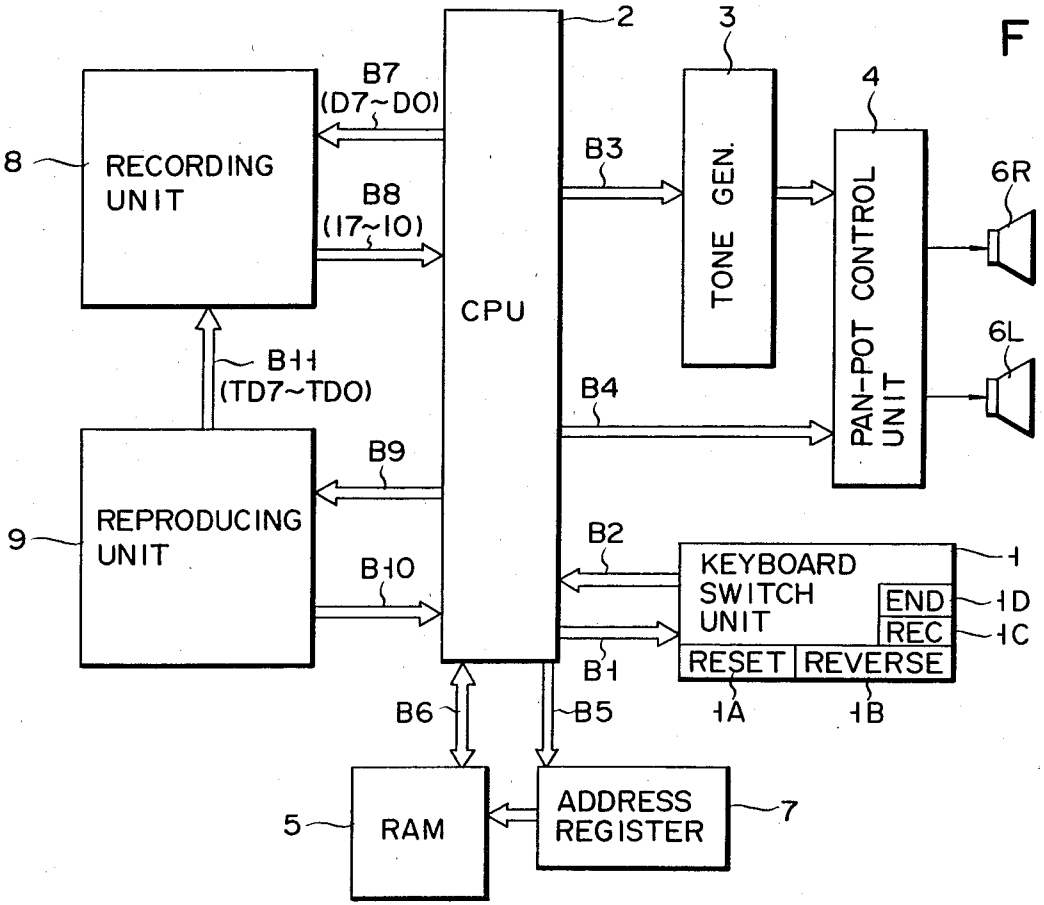
FIG. 1 is a block diagram showing the entire construction of an embodiment of the automatic music playing apparatus according to the invention.

FIG. 1 shows a block diagram of an electronic musical instrument with automatic music playing function. A keyboard switch unit 1 has a plurality of note keys and switches for providing various effects such as tone color, vibrato, sustain, stereophonic pan-potential, normal rhythm, fill-in rhythm and autoplay. It further has switches for use at the time of autoplay, i.e., a reset switch 1A, a reverse switch 1B, a record switch 1C and an end key 1D. The function of these switches will be described hereinunder. A central processing unit (hereinafter referred to as CPU) 2 periodically scans the keyboard switch unit 1 by supplying a scanning signal thereto along a bus line B1. In response to the scanning signal, the keyboard switch unit 1 produces output signals from various keys and switches, these output signals being supplied back to the CPU 2 via a bus line B2. In response to these output signals, the CPU 2 supplies tone generation command data to a tone generating unit 3 via a bus line B3. According to the tone generation command data, the tone generating unit 3 generates tone signals for melody and accompaniment, these tone signals being supplied to a tone image pan-pot control unit 4. The CPU 2 further supplies control data to the tone image pan-pot control unit 4 via a bus line B4 according to pan-pot data preset in a random access memory (hereinafter referred to as RAM) 5. The pan-pot control unit 4 sets a pan-pot for the tone signals noted above and produces corresponding signals supplied to a left and right loudspeaker 6R and 6L for sounding music. It may be of a construction as disclosed in U.S. patent application Ser. No. 530,028, for instance, or any other well-known construction.

The reading and writing of data from the RAM 5 are controlled according to address control data supplied from the CPU 2 to an address register 7 via a bus line B5. Data transfer between the CPU 2 and RAM 5 is done via a bus line B6. The RAM 5 has different memory areas, in which tone information indicative of the tone pitches, tone durations and rests of a piece of music and performance information indicative of various musical effects such as tone color, vibrato, sustain, pan-pot, fill-in rhythm "on" and "off", etc. are stored, respectively. The address register 7 has two independent address counters, one for the tone information and the other for the performance information. In an autoplay mode, the tone information and performance information noted above are simultaneously read out as parallel data in accordance with the progress of melody for the autoplay.

A recording unit 8 produces time data I7 to I0 indicative of the tone length from time data D7 to D0 supplied from the CPU 2 via a bus line B7, and time data TD7 to TD0 supplied from a reproducing unit 9 via a bus line B11. The time data I7 to I0 is supplied via a bus line B8 to the CPU 2 and thence to the RAM 5 to be written therein as the tone information or performance information.

In a reproducing or autoplay mode, data based on the tone information and performance information read out from the RAM 5 is supplied from the CPU 2 to the reproducing unit 9 via a bus line B9. According to this data, the reproducing unit 9 produces data necessary for a reproducing process to be supplied to the CPU 2 via a bus line B10. In the recording mode, it supplies the time data to the recording unit 8. The CPU 2 controls all the operations of the electronic musical instrument. Its construction may be a well-known one and will not be described. The recording and reproducing units 8 and 9 each have two identical and independently operative circuits, for the same reason as the address register 7 has two independent address counters.

Figure 2:
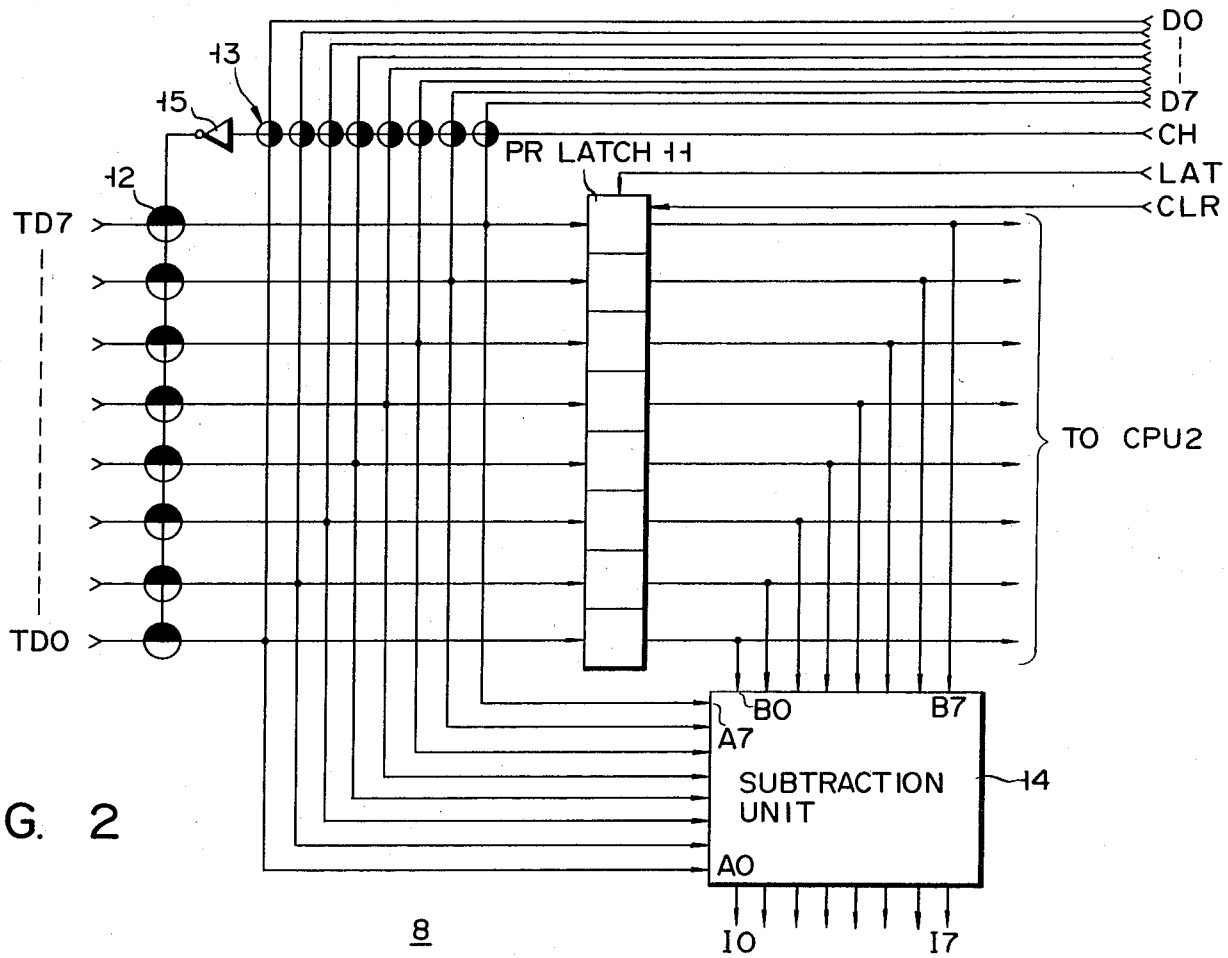
FIG. 2 is a schematic representation of the circuit construction of a recording unit 8 shown in FIG. 1.

The construction of the recording unit 8 will now be described with reference to FIG. 2. Normally, an output of an up/down counter, to be described later, in the reproducing unit 9 is supplied as the time data TD7 to TD0 to a PR latch 11 through a group of transfer gates 12. The PR latch 11 latches the input data when a latch command LAT is issued from the CPU 2. In the case when the reproducing mode is interrupted and a new recording is started after rewinding is done by operating the reverse switch 1B, the data in the PR latch 11 is transferred through the CPU 2 to a full adder, to be described later, in the recording unit 8. At this time, data in the full adder is transferred in turn as the time data D7 to D0 to the CPU 2, and thence through a group of transfer gates 13 to the PR latch 11 to be latched therein. The data latched in the PR latch 11 is supplied to a B input terminal group B7 to B0 of a subtraction unit 14. The time data TD7 to TD0 noted above is also supplied to an A input terminal group A7 to A0 of the subtraction unit 14. The subtraction unit 14 subtracts the data supplied to the B input terminal group from the data supplied to the A input terminal group, the result data I7 to I0 being transferred through the CPU 2 to the RAM 5 to be stored therein. In the case of the tone information, the data I7 to I0 serves as time data indicative of key-on and key-off time lengths. In the case of the performance information, on the other hand, it is indicative of the duration of effect generation. The transfer gates 12 are gate controlled by a signal CH supplied from the CPU 2 through an inverter 15 to their gate control terminal. The transfer gates 13 are gate controlled by the signal CH which is supplied directly to their gate control terminal.

The construction of the reproducing unit 9 will now be described with reference to FIGS. 5A and 5B. An up-down counter is 17 as noted above, which is an 8-bit counter, cleared by a clear signal CLR which is supplied from the CPU at the start of recording or reproduction, to count a clock based on a signal produced from a tempo oscillator 18.

The output frequency of the tempo oscillator 18 is variable by a tempo control variable resistor 19. The output of the tempo oscillator 18 is fed to one input terminal of a two-input AND gate 20. The AND gate 20 is gate controlled by the output a tempo stop switch $E_{SW}$ fed to the other input terminal. The output of the AND gate 20 is fed to a T-type flip-flop 21 and also to a transfer gate 23. The set output of the flip-flop 21 is fed to a T-type flip-flop 22 and also to a transfer gate 24. The set output of the flip-flop 22 is fed to transfer gate 25. The transfer gates 23 to 25 are gate controlled by the respective outputs of a tempo acceleration switch $C_{SW}$, a normal switch $F_{SW}$ and a slow tempo switch $D_{SW}$, these switches constituting a three-ganged lock switch such that only one of these three switches is "on". The outputs of the transfer gates 23 to 25 are counted as the clock noted above by the up/down counter 17. The flip-flops 21 and 22 constitute a frequency divider, and their output frequencies are one-half and one-fourth the output frequency of the tempo oscillator 18, respectively.

The up/down counter 17 is controlled for its up- or down-counting by the set output signal UP $\overline{\text{DWN}}$ of a flip-flop 26. To the set and reset input terminals S and R of the flip-flop 26 are supplied the respective outputs of a forward switch BSW and a reverse switch ASW (which is the same as the reverse switch 1B shown in FIG. 1), these switches constituting a two-ganged lock switch. Individual output bits of the up/down counter 17 are fed to one input terminal of respective two-input exclusive OR gates $27_7$ to $27_0$. They are also transferred as the data TD7 to TD0 to the recording unit 8. Individual output bits of an 8-bit ME latch 28 are fed to the outer input terminal of the respective exclusive OR gates $27_7$ to $27_0$. The outputs of the exclusive OR gates $27_7$ to $27_0$ are fed to a NOR gate 29, the output of which is supplied as a coincidence signal to the CPU 2. The exclusive OR gates $27_7$ to $27_0$ and NOR gate 29 constitute a coincidence circuit.

The NE latch 28 latches the result data, i.e., either sum or difference data, from an S output terminal group S7 to S0 of a full adder 30 noted above when a latch clock is supplied from the CPU 2. It is cleared by the clear signal CLR supplied from the CPU 2 at the start of the recording and reproducing processes. The data in the NE latch 28 is fed back through a group of transfer gates 31 to an A input terminal group A7 to A0 of the full adder 30. The outputs of two-input exclusive OR gates $32_7$ to $32_0$ are fed to respective B input terminals B7 to B0 of the full adder. The output of an AND gate 33 is fed through an inverter 34 and a transfer gate 35 to a carry input terminal $C_{IN}$ of the full adder 30. In response to key operation for new recording for correction, which is done subsequent to rewinding effected by interrupting the reproducing mode, the time data in the PR latch 11 in the recording unit 8 is supplied to one input terminal of the exclusive OR gates $32_7$ to $32_0$. The output of the AND gate 33 is fed to the inverter 34 and transfer gate 35 to the other input terminal of the exclusive OR gates $32_7$ and $32_0$.

The AND gate 33 is a two-input AND gate, with the set output of the flip-flop 26 fed to one input terminal and a signal R supplied from the CPU 2 to the other input terminal. The signal R is normally "1" and temporarily rendered "0" at the time of the recording for correction as noted above. The output of the AND gate 33 is further supplied to the CPU 2. The transfer gates 31 and 35 are gate controlled by a signal CHR supplied form the CPU 2. The signal CHR is temporarily rendered "0" when making the recording for correction. The output of the transfer gate group 31, which is latched in the NE latch 28, is transferred to the PR latch 11 noted above when making data correction.

Figures 7, 8:
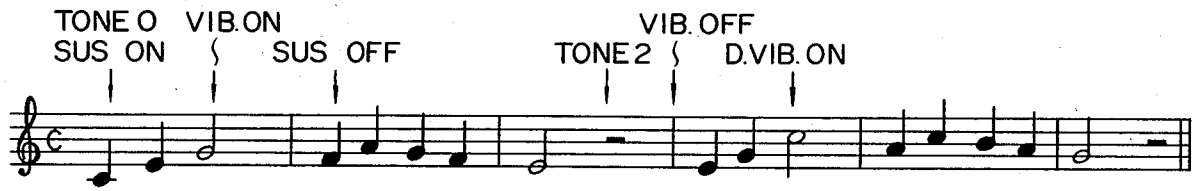
FIG. 7 is a view showing an example of music.
FIG. 8 a view showing tone color data and corresponding set data.

FIG. 8 shows 10 different tone color data 01H to 0AH for respective tone colors TONE 0 to TONE 9, which can be provided by the CPU 2. FIG. 9 shows setting data 1DH to 9FH which are provided by the CPU 2 in response to respective switch operations, i.e., turning on and off of the sustain switch, turning on and off of the vibrato switch and turning on and off of the delay vibrato switch. FIG. 10 shows pan-pot data. In this embodiment, seven different sound image pan-pot positions, i.e., a center position, and three left and right positions, can be set. The CPU 2 can provide seven different sound image pan-pot data 7BH to 75H as shown according to data input by switch operation. FIG. 11 shows setting data 1BH and 9BH provided by the CPU 2 when the fill-in rhythm switch is turned on and off, respectively.

Figure 3A:
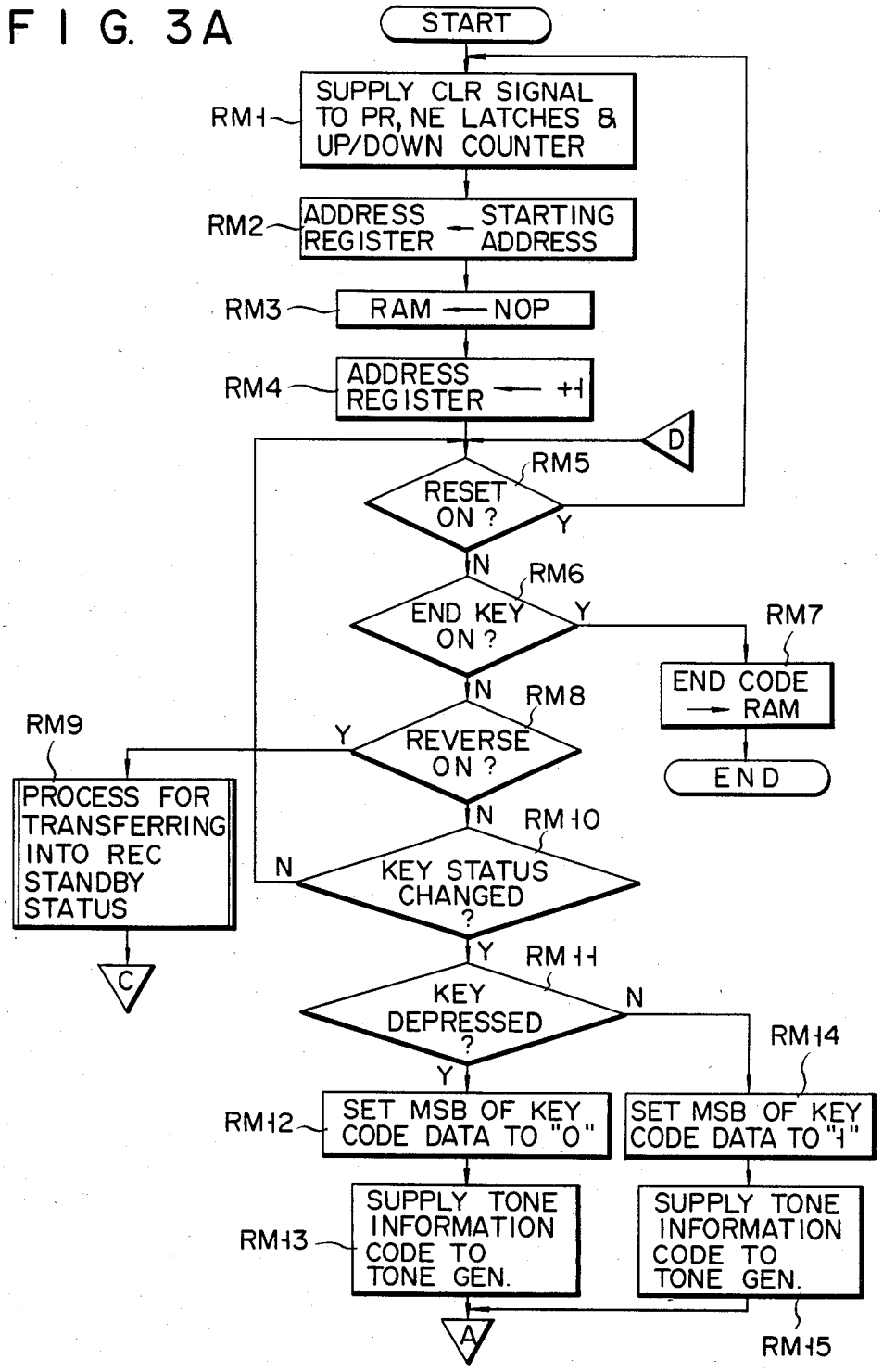
FIGS. 3A and 3B are flow charts illustrating a process of recording tone information.
Figure 3B:
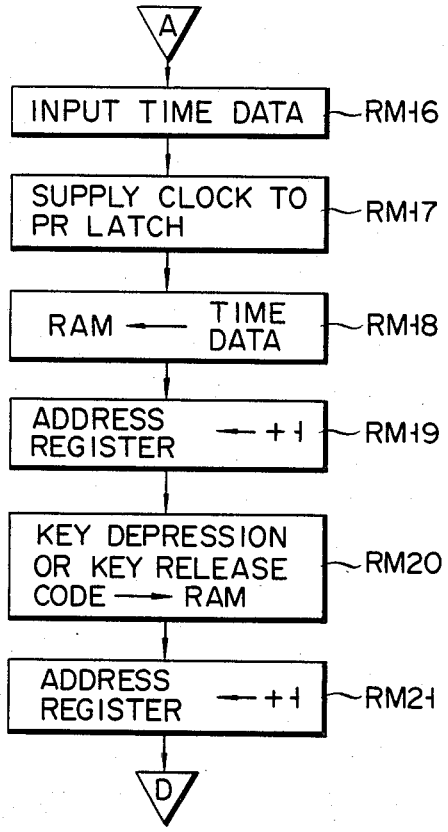

Now, the operation of the embodiment will be described in connection with the recording and reproduction of data of a piece of music as shown in FIG. 7 in and from the RAM 5. The operation for recording will first be described. In the recording, tone information of the music is first recorded by operating the keys in the keyboard switch unit 1. FIG. 3A and 3B show the routine for this recording operation.

Figure 4:
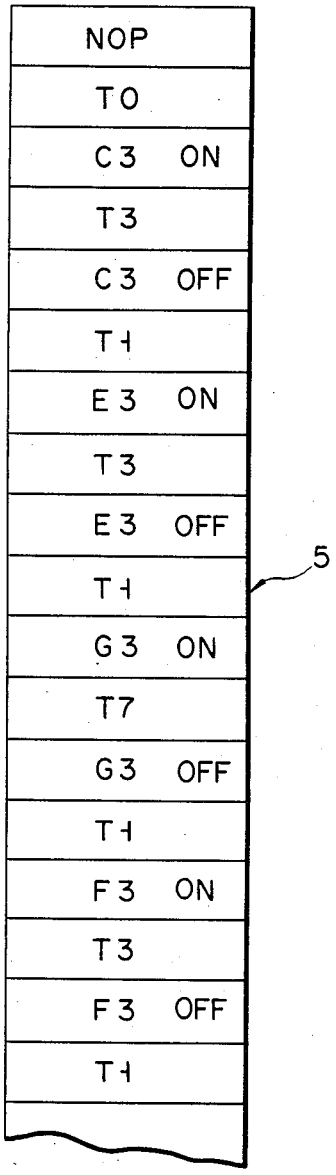
FIG. 4 is a view showing a form, in which tone information shown in FIG. 7 is stored in a RAM 5 in FIG. 1.

The recording is started by turning on a recording start switch (not shown). The output of this switch is supplied to the CPU B2 via the bus line 2. In response to this output, the CPU 2 executes a step RM1 in the flow chart of FIG. 3A, in which it supplies the clear signal CLR to the CR latch 11, NE latch 28 and up/down counter 17 via the bus lines B7 and B9 to clear the latches and counter. Then it executes a step RM2 of supplying address control data for setting a starting address of tone information in the RAM 5 to set this data in the tone information address counter in the address register 7. Then it executes a step RM3 of writing data NOP into the starting address noted above (i.e., address 0) of the RAM 5 via the bus line B6. FIG. 4 schematically shows various data stored. The data NOP (non-operation) is a data like a rest indicative of production of no musical sound. The CPU 2 then executes a step RM4 of incrementing the aforementioned address counter in the address register 7 (hereinafter merely referred to as address register 7) by +1 to set address 1. Then it executes a step RM5 of checking whether the reset switch 1A has been turned on. The reset switch 1A is turned on when making recording for correction. If it is found to have been turned on, the routine returns to the step RM1. If the reset switch 1A has not been turned on, the CPU executes a step RM6 of checking whether the end key 1D has been turned on. The end key 1D is turned on at the end of the input of tone information to write an end code at the end of the tone information recorded in the RAM 5. When it is turned on, the step RM6 thus yields Y (yes), so that the CPU executes a step RM7 of writing the end code, thus bringing an end to the routine. In the instant case, the end key 1D has not been turned on yet, so that the step RM6 yields N (no). The CPU thus executes a step RM8 of checking whether the reverse switch 1B (i.e., reverse switch ASW) has been turned on. If the reverse switch 1B has been turned on, the routine goes to a step RM9, which is a process for bringing about a recording standby status. This process will be described later in detail. In the instant case, the reverse switch 1B of course has not been turned on, so that the CPU executes a step RM10 of checking for any key status change. The consecutive steps RM5, RM6, RM8 and RM10 are repeated on and on until the key for the first tone (of note C3) of the music of FIG. 7 is turned on together with the recording start switch to produce the sound of this tone. When the key for C3 is turned on, the CPU executes a step RM11 of checking whether the pertinent key is depressed or released. Since the key is depressed, it then executes a step RM12 of setting the most significant bit (MSB) of key code data for the note C3 to "0" to indicate that this code data is key depression data. In a subsequent step RM13, it supplies the tone information code thus obtained to the tone generating unit 3 for sounding the tone from the loudspeakers 6R and 6L. Then it executes a step RM16, in which it sets the signal CH to "0" to enable the transfer gates 12 and disable the transfer gates 13. Thus, the count output of the up/down counter 17 in the reproducing unit 9, which has been counting the clock of the set tempo subsequent to the clearing step RM1 noted above (i.e., up-counting the clock since the forward switch BSW has been "on" and the flip-flop 26 has been set), is supplied as time data TD7 to TD0 via the bus line B11 and through the transfer gates 12 to the PR latch 11 and A input terminal group of the subtraction unit 14 in the recording unit 8 of FIG. 2. The subtraction unit 14 subtracts the data input from the PR latch 11 to the B input terminal group from the data input to the A input terminal group, the result data being supplied as time data to the CPU 2. The CPU then executes a step RM17 of supplying the latch signal LAT to the PR latch 11 to cause the same to latch the input data. The latched data is fed to the B input terminal group of the subtraction unit 14. The CPU then executes a step RM18 of writing the time data in the RAM 5. In the instant case, the data input to both the input terminal groups of the subtraction unit 4 are of the same value, and the result data I7 to I0 at this time is "0". The result data is written in the address 1 of the RAM 5 noted above. It is shown as "T0" in FIG. 4, which indicates that the time data is "0". The CPU then executes a step RM19 of incrementing the address register 7 by +1 to set address 2. Then it executes a step RM20 of writing the key code data for C3 with the key depression code "0" in the address 2 of the RAM 5. Then it executes a step RM21 of incrementing the address register by +1 to set address 2. The routine then returns to the step RM5.

The consecutive steps RM5, RM6 and RM8 are thus subsequently executed. If the release of key is detected in the step RM11, the CPU executes a step RM14 of setting the MSB of the key code for the note C3 to "1" to indicate that this code data is the key release data. In a subsequent step RM15, it supplies this data to the tone generating unit 3, whereby the sound production for the tone of the note C3 is stopped. The CPU subsequently executes the consecutive steps RM16 and RM17. At this time, the time data in the up/down counter 17 at the time of the key release noted above is latched as new data in the PR latch 11 and thence fed to the subtraction unit 14. The subtraction unit 14 thus subtracts the time data input to the B input terminal group at the time of the key release from the time data input to the A input terminal group, the result time data being written in the address 3 of the RAM 5 in the step RM18. The time data at this time is "T3" as shown in FIG. 4, which is the key-on period corresponding to quarter note as the tone length of the note C3. The key release code is written in the address 4 of the RAM 5 in the step RM19. Then address 5 is set in the step RM20, before the routine goes to the step RM5.

When the key for the note E3 of the second tone is depressed, this is detected in the step RM10, so that the steps RM11 and RM12 are executed to obtain the key depression code for this note in the manner as described before in connection with the depression of the key for the note C3. In the subsequent step RM13, the tone of the note E3 is sounded. Through the subsequent steps RM16, RM17 and RM18, the time data at the time of the depression of the key for the note E3 is latched in the PR latch 11. At this time, the subtraction unit 14 subtracts the time data at the time of the release of the key for the note C3 input to the B input terminal group from the time data at the time of the depression of the key for the note E3, the resultant data being written in the address 5 of the RAM 5. This data is shown as "T1" in FIG. 4, which represents the key-off time of the key for the note C3. The sum of the key-on time of the quarter note noted above and the instant key-off time is "T4". In the step RM21 subsequent to the step RM20, address 6 of the RAM 5 is set. The routine is then returned to the step RM5.

The process that takes place when the key for the note E3 is released is the same as at the time of the release of the key for the note C3. Further the operation as described is executed for the third tone G3 and following tones in FIG. 7. When the operation for the last half-rest is completed, the end key 1D is turned on to write an end code as the last data of the tone information in the RAM 5. As is seen from FIG. 4, the time data of the key-off time of each tone is "T1", so that the sum of the time data of the key-on time and key-off time of the half-note of the third tone C3 is "T8", i.e., double the quarter note. The time data of the key-off time of the half-note is thus "T7".

The process of a step RM9 which is executed when the reverse switch 1B is turned on, will now be described. The reverse switch 1B (reverse switch $A_{SW}$) is turned on when a wrong key is operated in the recording of tone information as described. When it is turned on, the flip-flop 26 is reset to provide a down-counting command to the up/down counter 17. The up/down counter 17 thus is caused to down-count to the pertinent address, whereby a recording standby status is brought about to be ready to record right tone information. With the reverse switch 1B turned on, the data in the PR latch 11 is transferred through the CPU 2 to the NE lacth 29 in the reproducing unit 9 to be latched therein.

After the tone information has been written in the RAM 5 in the manner as described, information about various musical effects, i.e., performance information, of the music of FIG. 7 is written in the RAM 5. This operation will now be described with reference to the flow chart of FIG. 12. In this operation, the tone information having been recorded is automatically reproduced, so that the performance information can be written in the RAM 5 while listening to the autoplayed melody. Such input system permits the location of the input effect information to be easily grasped, and this facilitates the input operation. The operation of reproduction of melody will be first described with reference to the flow chart of FIG. 6A.

Figure 5A:
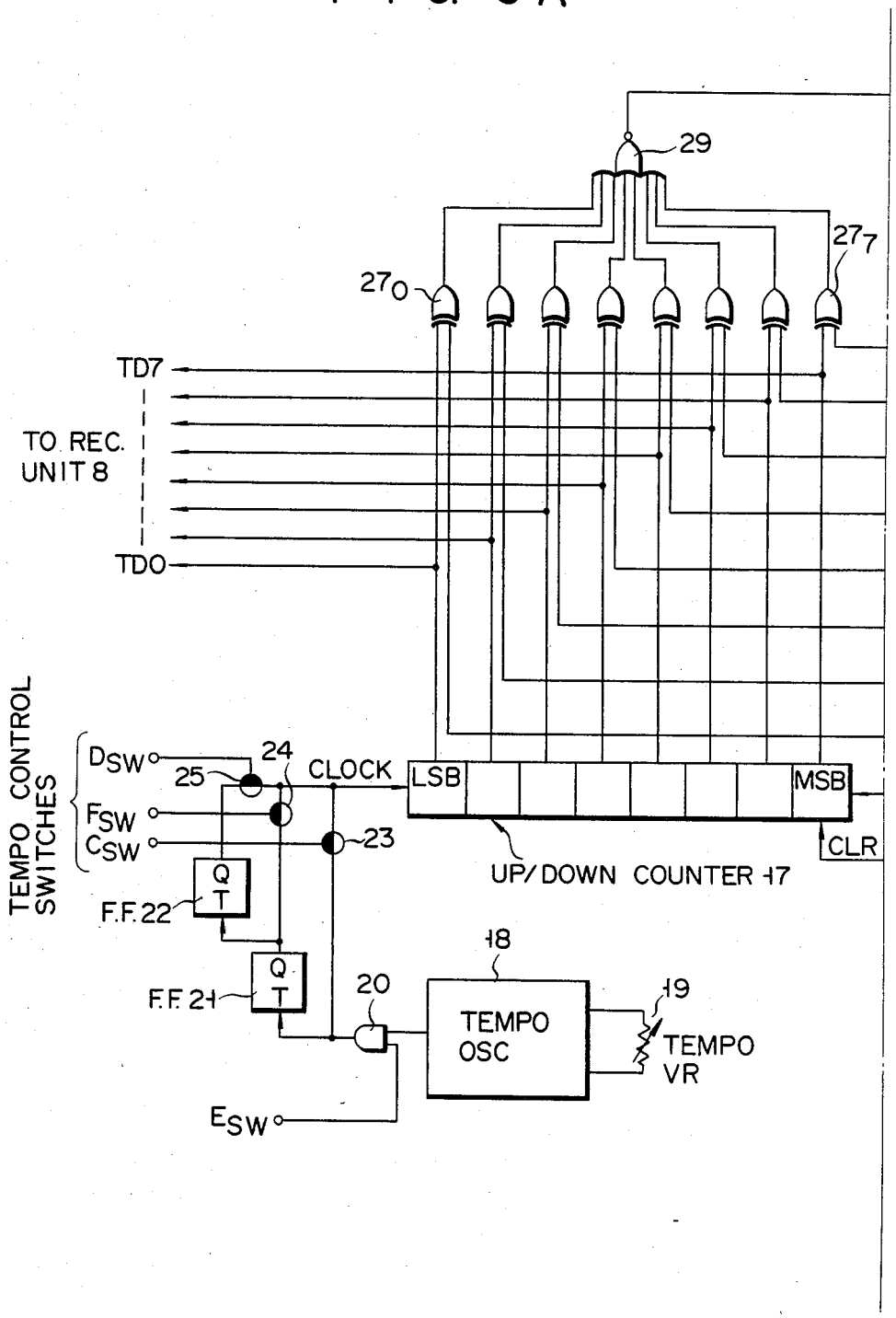
FIGS. 5A and 5B are a schematic representation of the circuit construction of a reproducing unit 9 shown in FIG. 1.
Figure 5B:
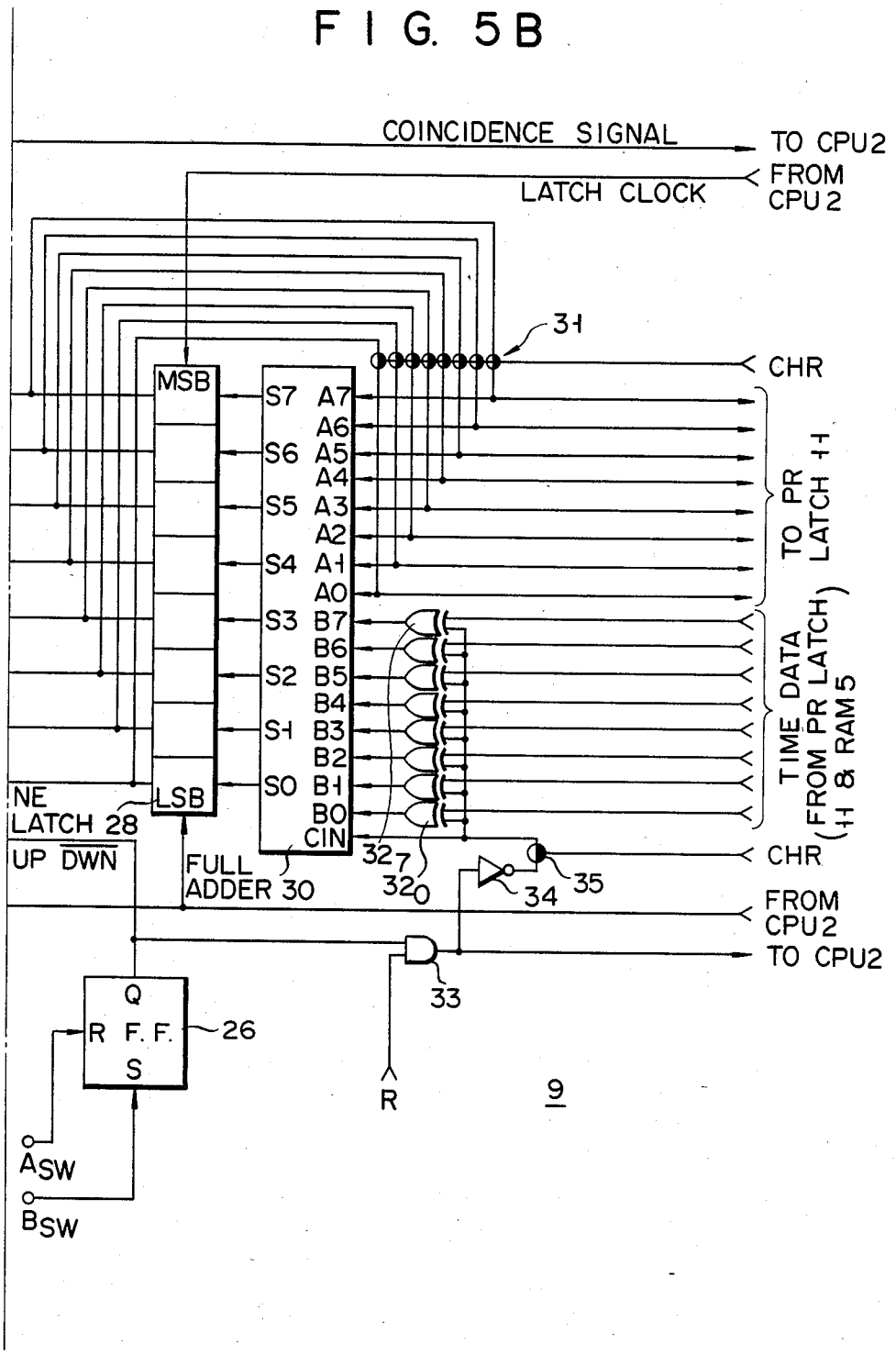

When a reproduction start switch (not shown) is turned on, the CPU 2 first executes a step SM1 of supplying the clear signal CLR to the NE latch 28 and up/down counter 17 shown in FIG. 5A to clear them. Then it executes a step SM2 of setting a starting address of the tone information written in the RAM 5 in the address register 7. Next, it executes a step SM3 of reading out the data NOP (see FIG. 4) from the RAM 5, and then it executes a step SM4 of incrementing the address register 7 by +1 to set address 1. Next, it executes a step SM5 of checking whether the MSB of the data NOP noted above is "0" or "1". Since the data NOP at this time is like a rest, the CPU executes a step SM7 of supplying this data and key-off signal as control signal to the tone generating unit 3 to keep the tone generating operation thereof inhibited. Then it executes a step SM9 of incrementing the address register 7 of by +1 to set address 2. Next, it executes a step SM10 of supplying the time data T0 in the address 1 to the B input terminal group of the full adder 30, and then it causes the result data to be latched in the NE latch 28 in a step SM11. In this case, the forward switch $B_{SW}$ is "on" to have the flip-flop 26 set, thus having the AND gate 33 enabled and having the up-counting command to the up/down counter 17. Also, the signal R is normally "1". Thus, the output of the AND gate 33 is normally "1", which is fed to the CPU 2, while the output of the inverter 34 is normally "0", which is fed to one input of the exclusive OR gates $32_7$ to $32_0$ and also to the carry input terminal $C_{IN}$ of the full adder 30. The signal CHR is normally "1" to have the transfer gates 31 and 35 enabled.

Thus, through the steps SM10 and SM11 the time data T0 is fed without being inverted by the exclusive OR gates $32_7$ to $32_0$ to the B input terminal group of the full adder 30. Meanwhile, the output data of the NE latch 28 (which is an 8-bit all "0" data) is fed as the output of the transfer gates 31 to the A input terminal group of the full adder 30. The full adder 30 thus provides result data of "0", which is latched in the NE latch 28.

The CPU subsequently executes a step SM12 of checking whether the coincidence signal form the NOR gate 29 is "1". In the instant case, the exclusive OR gates $27_7$ to $27_0$ are receiving the 8-bit all "0" data of the up/down counter 17 and the 8-bit all "0" data of the NE latch 28, so that a coincidence signal of "1" is supplied to the CPU. The CPU thus executes a step SM13 of checking whether the up/down counter 17 is up- or down-counting. Since the up/down counter 17 is up-counting, the routine is returned to the step SM3.

In the step SM3, the key code C3 and key depression data "0", shown as C3 ON in FIG. 4, are now read out from the address 2 of the RAM 5 by the CPU 2. In the next step SM4, address 3 is set in the RAM 5. In the subsequent step SM5 the key depression data of "0" is detected, so that the CPU executes a step SM6 of supplying the key code C3 and key-on signal to the tone generating unit 3. As a result, the first tone of C3 in the music of FIG. 7 is reproduced and sounded through the loudspeakers 6R and 6L. In the subsequent step SM8, the CPU reads time data T3 from the address 3 of the RAM 5, and in the step SM9 it sets address 4 in the RAM 5. Time data T3 is fed as such to the B input terminal group of the full adder 30. At this time, the full adder 30 is receiving time data "0" latched in the NE latch 28. Thus, its result data at this time is equal to the time data T3, which is newly latched in the NE latch 28 and thence fed to the exclusive OR gates $27_7$ to $27_0$ in the step SM11. While the level of the coincidence signal checked in the step SM12 is not "1" yet, the CPU executes a step SM14 of checking whether the signal UP $\overline{\text{DWN}}$ is inverted, i.e., whether the reverse switch ASW is turned on. Since the reverse switch ASW is not turned on, it executes a step SM18 of checking whether the prevailing status is the recording status for tone information correction. Since the answer is "no", it executes a step SM20 of checking whether the reset switch 1A is "on". Since the answer is again "no", the routine returns to the step SM12. The consecutive steps SM14, SM18 and SM20 are repeated on and on until the coincidence signal becomes "1".

When the coincidence signal goes to "1" after the lapse of the key-on time of the key code C3 for the first tone, i.e., time data T3, the routine goes through the step SM15 to the step SM3, in which the CPU now reads out the key code C3 and key release data "1", shown as C3 OFF in FIG. 4, from the address 4 of the RAM 5. The CPU then sets address 5 of the RAM 5 in the step SM4. In the next step SM5, it detects the MSB key release data "1", so that it executes the step SM7 of supplying the key code C3 and key-off signal to the tone generating unit 3 to stop sound production of the tone C3. In the subsequent step SM8, it reads out time data T1 from the address 5 of the RAM 5, and then it sets address 6 of the RAM 5 in the step SM9. Through the subsequent steps SM10 and SM11, the time data T1 is fed as such to the A input terminal group of the full adder 30. Since the previous result data, i.e., time data T3, is at its B input terminal group, the output of the full adder 30 this time is T4, which is latched in the NE latch 28 and thence fed to the exclusive OR gates $27_0$ to $27_7$. The CPU then executes the step SM12 and subsequently repeatedly executes the steps SM14, SM18, SM20 and SM21 until the coincidence signal becomes "1" with the reaching of the time data T4 by the count of the up/down counter 17. During this time, the sound of the first tone C3 is already "off". With the transition of the coincidence signal to "1", the step SM13 is executed, and the routine is returned to the step SM3.

Figure 12:
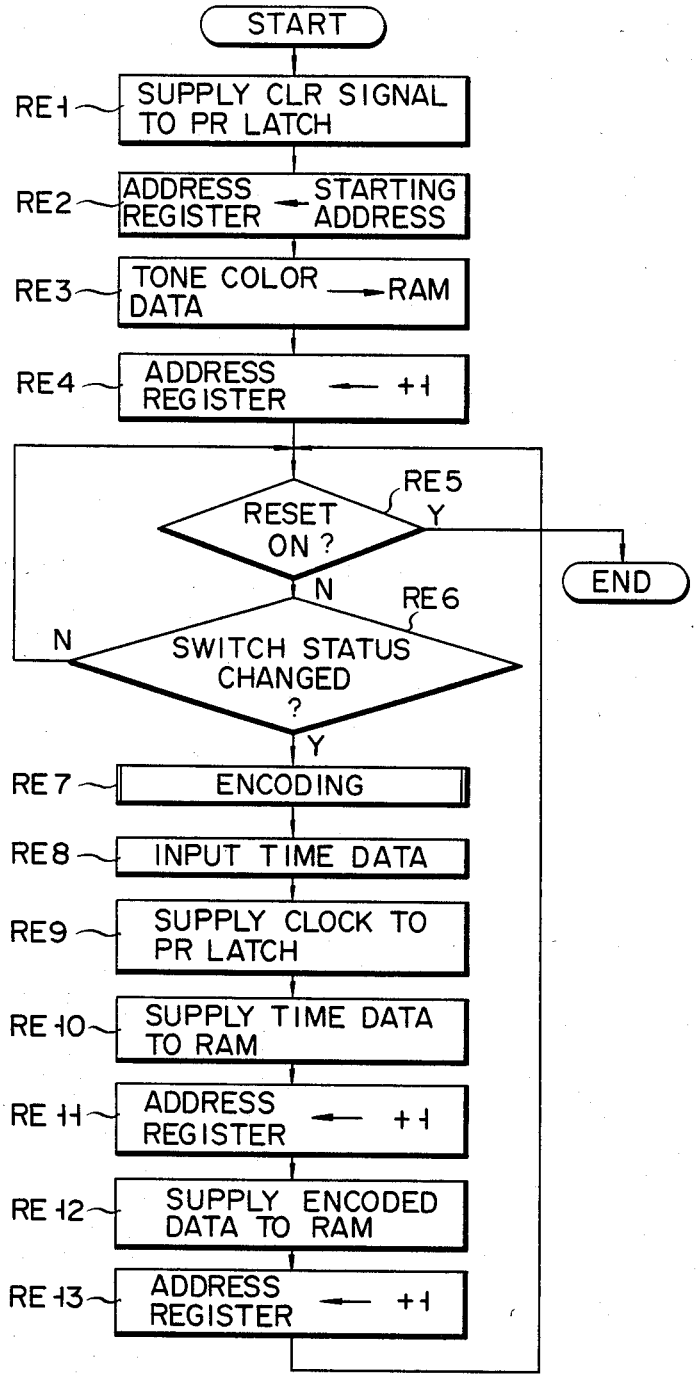
FIG. 12 is a flow chart illustrating a process of recording performance information.

After the reproducing operation with respect to the first tone C3 has been completed, the second tone E3 is then reproduced in a similar operation. While the first tone C3 is being reproduced in the manner as described, the tone color TONE 0 and data SUS ON are input into memory by operating the tone color designation switch and substain switch in the keyboard switch unit 1 respectively according to the music score in FIG. 7. According to this input operation, a routine as shown in the flow chart of FIG. 12 is executed. This operation will now be described.

First, the tone color switch and sustain switch are turned on. Then the effect recording start switch is turned on. As a result, the CPU executes a step RE1 of supplying the clear signal CLR to the PR latch 11 to clear the same. Then it executes a step RE2 of clearing the performance information address counter in the address register 7 and setting the starting address of the area other than the tone information area in the RAM 5. Next it executes a step RE3 of writing the tone data "01H" as shown in FIG. 8 in the starting address (i.e., address 0). Then it executes a step RE4 of incrementing the aforementioned address counter in the address register 7 (hereinafter referred to merely as address register 7) by +1 to set address 1. Then it executes a step RE5 of checking whether the reset switch 1A is "on". Since the reset switch 1A is not on, it then executes a step RE6. When the reset switch 1A is turned on, an end is brought to the routine of FIG. 12. In the step RE6, the CPU checks for any switch status change. Without any switch status change, the step RE5 is executed again. The steps RE5 and RE6 are executed repeatedly until an effect switch such as the tone designation switch is turned on. In the instant case, the sustain switch has been turned on, this is detected in the step RE6, so that the CPU executes a subsequent step RE7 of encoding this fact, i.e., it supplies sustain-switch-on data 1DH as shown in FIG. 9. The CPU has been holding the signal CH "0" to hold the transfer gates 12 enabled and the transfer gates 13 disabled. In a subsequent step RE8, it transfers the time data in the up/down counter 17 at this time to the PR latch 11 and A input terminal group of the substraction unit 14. In a subsequent step RE9, it supplies the latch signal LAT to the PR latch 11 to cause the time data to be latched therein and thence fed to the B input terminal group of the subtraction unit 14. The subtraction unit 14 thus produces result data of "0" from the same time data into both its input terminal groups. In a subsequent step RE10, the CPU writes this time data, which is shown as T0 in FIG. 13, in the address 1 of the performance information area of the RAM 5. Then it executes a step RE11 of incrementing the address register 7 to set address 2. Next, it executes a step RE12 of writing the sustain data 1DH noted above into the address 2 of the RAM 5, and then it executes a step RE13 of incrementing the address register 7 by +1 to set address 5 of the RAM 5. The routine then returns to the step RE5.

Figure 13:
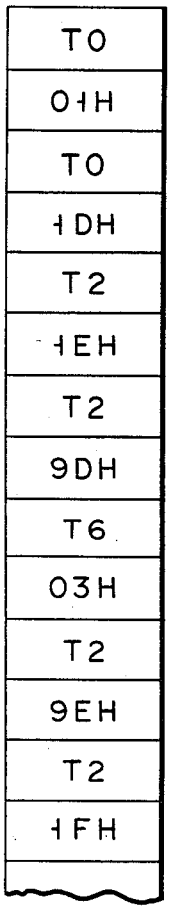
FIG. 13 is a view showing a form, in which the performance data is stored in the RAM.

Subsequently, as soon as the sounding of the third tone of G3 of the music is started, the vibrato switch is turned on by the operator. The CPU detects this in the step RE6, and supplies data 1EH, as shown in FIG. 9, in the step RE7. In the subsequent step RE8, the time data in the up/down counter 17 at this time is fed to the PR latch 11 and B input terminal group of the subtraction unit 14. Then in the step RE9, the time data is latched in the PR latch 11 and thence fed to the A input terminal group of the subtraction unit 14. The result data obtained by the subtraction of the previous time data at the B input terminal group from the data at this time, as shown as T2 in FIG. 13, is written in the address 3 of the RAM 5. In the subsequent step RE11, the address register 7 is incremented by +1 to set address 4. In the next step RE12, the data 1EH is written in the address 4. In the subsequent step RE13 the address register 7 is incremented by +1 to set address 5. Now, the routine returns to the step RE5.

The reproducing operation then proceeds according to the flow chart of FIG. 6A, and as soon as the sounding of the third tone of F3 is started, the sustain switch is turned off by the operator, thus effecting the writing of the data SUS OFF. As a result, the time data T2 for the third and fourth tones and data 9DH, as shown in FIG. 9, are written in the addresses 5 and 6 of the RAM 5 through RE5 to RE13. The other effect data such as data TONE 2, as shown in FIG. 7, are also written in correspondence to the time data in the RAM 5 in the manner as described above.

Figure 6B:
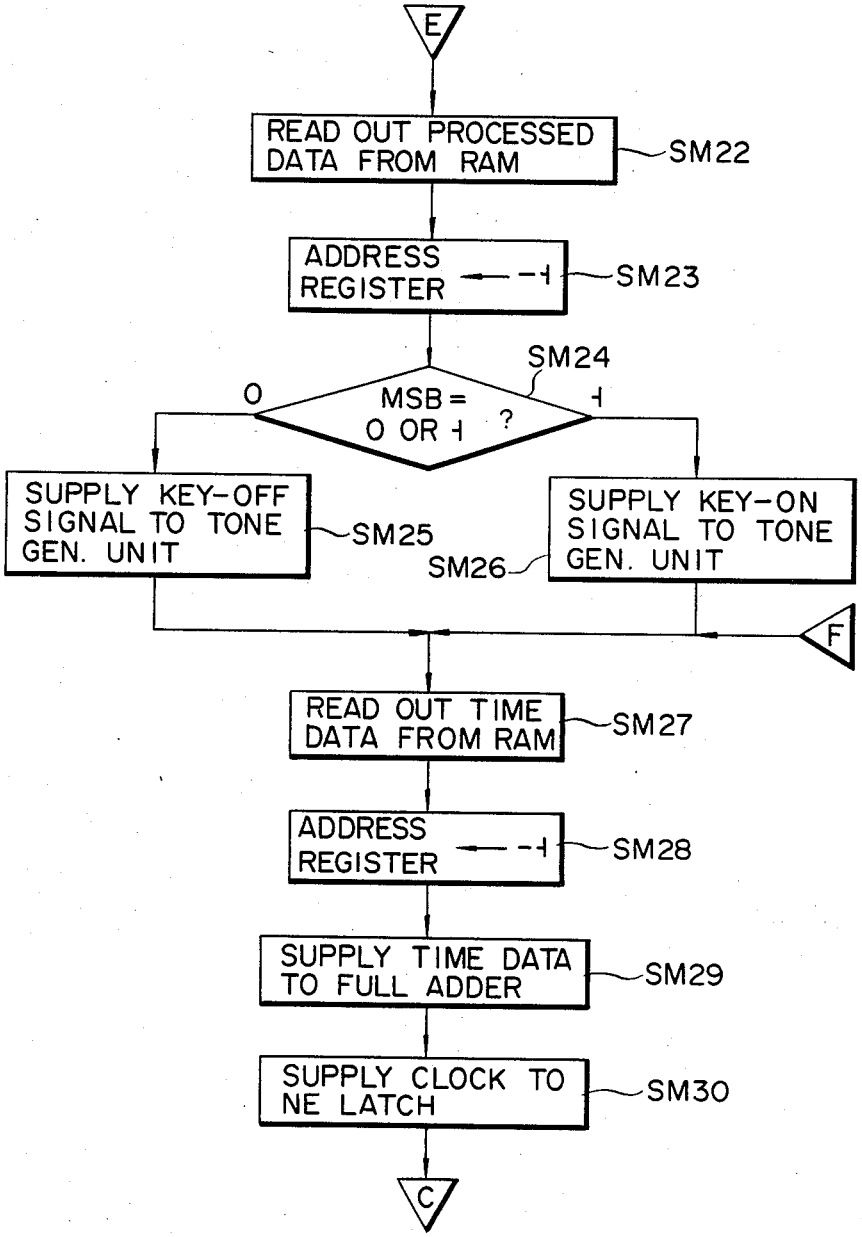

After the recording of the tone information and performance information according to the flow charts of FIGS. 3 and 12 has been completed, the tone information can be corrected during reproduction of the melody according to the flow chart of FIG. 6B. This operation will now be described. During the reproduction of the melody, the performance information is simultaneously reproduced in the order as in the music score of FIG. 7. This operation, however, will be described later in detail with reference to the flow chart of FIG. 14.

It is now assumed that the reproduction is interrupted, at an instant when the third tone of G3 in the music score of FIG. 7 is being sounded, by turning on the reverse switch (i.e., reverse switch $A_{SW}$) for rewinding. With the reverse switch turned on, the flip-flop 26 is reset to disable the AND gate 33, so that the output thereof supplied to the CPU 2 goes to "0". At the same time, a down-counting command is supplied to the up/down counter 17 to start the down-counting thereof. At this moment, the tone information counter in the address register 7 is designating address 12, in which key release code G3 OFF is set. Also, time data T15 (i.e., total time data up to address 11) is latched in the NE latch 28.

With the reverse switch 1B turned on, the CPU 2 detects inversion of the signal UP$\overline{\text{DWN}}$ in the step SM14 subsequent to the step SM12. Thus, it executes a step SM15 of checking whether the up/down counter 17 is up- or down-counting. Since the down-counter 17 is down-counting (causing rewinding), it then executes a step SM17 of incrementing the address register 7 by −1 to set address 11. Then it executes a step SM27 in the flow chart of FIG. 6B. In this step, it reads out the time data T7 noted above from the address 11 of the RAM 5 and feeds the data to the exclusive OR gates $32_7$ to $32_0$. Since the output of the AND gate 33 is "0", the time data T7 is inverted by the exclusive OR gates $32_7$ to $32_2$ before it is fed to the B input terminal group of the full adder 30. The full adder 30 is received a signal of "1" at its carry input terminal $C_{IN}$ since the output of the AND gate 33 is "0". That is, after the reverse switch 1B is turned on, it serves as a subtractor to subtract the time data T7 at its B input terminal group form the time data T15 input to its A input terminal group from the NE latch 28. The result data T8 is supplied to the NE latch 28 in a step SM29. Before this is done, the address register 7 is incremented by −1 to set address 10 in a step SM28. Subsequent to the step SM29, the CPU executes a step SM30 of supplying the latch signal LAT to the NE latch 28 to latch the time data T8. The routine then returns to the step SM12.

When the count output (i.e., time data) of the up/-down counter 17, which has started the down-counting with the turning-on of the reverse switch 1B, is reduced to the value corresponding to the time data T8, the coincidence signal is detected in the step SM12. During this time, the third tone of G3 is sounded. Since the three effects TONE 0, SUS ON and VIB ON shown in FIG. 7 are specified, these effects are attached to the sound produced. If the reverse switch 1B is still "on" at the time of the issuance of the coincidence signal, the CPU reads out the key depression code G3 ON from the address 10 of the RAM 15 in the step SM22, and also it increments the address register 7 by −1 to set address 9 of the RAM 5 in the subsequent step SM23. Then it detects in the step SM24 that the key depression data for this key code data is "0", so that it executes the step SM25 of supplying the key-off signal to the tone generating unit 3. The reproduction of the third tone of G3 and three effect sounds is thus stopped by the rewinding caused by the turning-on of the reverse switch 1B. Subsequently, the CPU reads out the time data T1 from address 9 of the RAM 5 in the step SM27. This data is inverted to be fed to the B input terminal group of the full adder 30. The CPU then executes the step SM28 of incrementing the address register 7 by −1 to set address 8. In the subsequent step SM29 it supplies the time data T8 to the A input terminal group of the full adder 30. The full adder 30 subtracts the time data T1 at the B input terminal group from this data. In the subsequent step SM30 this time the result data T7 is latched in the NE latch 28. The routine then returns to the step SM12 for checking the coincidence signal. When down-counting has been done to the extent corresponding to the time data T1 subsequent to the stopping of the sounding of the third tone G3, the coincidence signal noted above is issued to cause the step SM13. The time interval T1 is the key-off time for the third tone G3. The CPU subsequently executes the step SM22, in which it reads out the key release code E3 OFF from address 8. Subsequent steps SM23, SM24, SM26, SM27 to SM30 and SM12 are executed for reproduction and sounding of the second tone E3 by rewinding. The sounding is then stopped and then the start and stop of the sounding of the first tone C3 are effected in the manner as described before.

The operation for correcting the tone information at a certain position by rewinding will now be described. It is now assumed that the third tone of G3 is to be corrected. To this end, the reverse switch 1B is turned off while the second tone E3 is being sounded. As a result, inversion of the signal UP $\overline{\text{DWN}}$ from the "$\overline{\text{DWN}}$" side to the "UP" side is effected and detected in the step SM14. The steps SM15 and SM16 are thus executed to increment the address register 7 BY +1 to set address 7. Through the subsequent steps SM8 to SM11, the time data T3 is read out from address 7 of the RAM 5, and the address register 7 is incremented by +1 to set address 8. Meanwhile, with the turning-off of the reverse switch 1B the flip-flop 26 is set to change the output level of the AND gate 3 to "1" to recover the adder function of the full adder 30. At the same time, the up/down counter 17 resumes the up-counting. At this time, the full adder 30 adds the previous time data T4 and the time data T5 read out this time, the sum T7 being latched in the NE latch 28. Then the step SM12 is executed, and the second tone E3 is sounded continually even after the reverse switch 1B is turned off.

After the reverse swtich 1B is turned off, the recording switch 1C is turned on to set the recording mode for the correction recording. When this is done, the step SM14 is executed before the coincidence signal with respect to the second tone key code data E3 OFF is detected in the step SM12. Then, the recording mode is detected in the step SM18. When a correcting note key (for instance for note A3) is then turned on, the CPU detects this in the step SM19, so that it executes a step SM21, which is a process for setting the recording mode for the correction recording of the tone A3 of the operated key.

In this instance, the signal R is temporarily rendered "0' to temporarily render the output of the AND gate 33 "0". The full adder 30 is thus temporarily rendered to be a subtractor. In this case, the time data T1 from address 9 of the RAM 5 with respect to the key release code of the second tone, is inverted before it is fed as time data input to the B input terminal group of the full adder 30. The result data of the full adder 30 at this time is thus T7, which is latched in the NE latch 28 and thence transferred to the recording unit $37_8$. Subsequently, the signal R is inserted again to "1" to recover the adder function of the full adder 30. At the same time, the signal CH is temporarily rendered "1" to enable the transfer gates 13 and disable the transfer gates 12 to effect latching of the time data T7 from the NE latch 28 into the PR latch 11. As soon as this is effected, the signal CH is inverted to "0" again to recover the previous status. Meanwhile, the subtraction unit 14 effects subtraction with respect to the data latched in the PR latch 11 (i.e., the time data T7). The result data is written as the time data of the tone to be corrected in the RAM 15 (in this case address 9 thereof). The key code data A3 ON of the correcting note key is then written in address 10. The correction of various effects provided on the musical score in FIG. 7 can be effected by similar switching operation to that in the case of the tone information correction as described above. In this case, the same routine as described above takes place.

Now, the operation of reproduction of various musical effects written in the RAM 5 in an area thereof different from the tone information area, as shown in FIG. 13, will be described with reference to FIG. 14. In this case, the reproduction of the tone information and that of the performance information are brought about simultaneously according to the music score in FIG. 7, by the parallel operation of the two address counters in the address register 7 as mentioned earlier.

Figure 14:
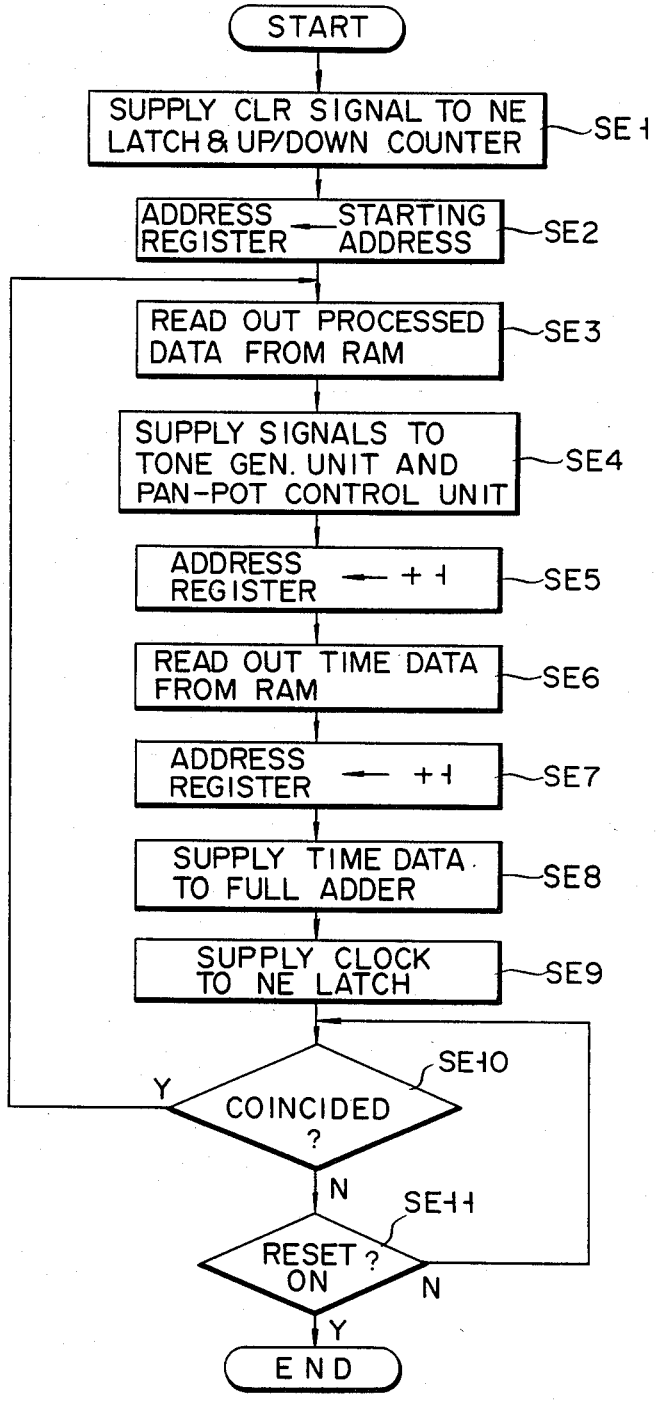
FIG. 14 is a flow chart illustrating a process of reproducing the performance data stored in the RAM.

Referring to FIG. 14, when the reproduction is started, the CPU first executes a step SE1 of supplying the clear signal CLR to clear the NE latch 28 and up/-down counter 17 as described above. Then it executes a step SE2 of setting the starting address of the performance information counter in the address register 7 (hereinafter referred to as address register 7). Next, it executes a step SE3 of reading out the effect data, in the instant case tone color data 01H from the starting address of the RAM 5. In a subsequent step SE4, it supplies this data to the tone generating unit 3 and pan-pot control section 4. The tone color noted is thus attached to the subsequent tone information. In a subsequent step SE5, the CPU increments the address register 7 by +1 to set address 1. Then it executes a step SE6 of reading out the time data T1 (as shown in FIG. 13) from the address of the RAM 5. Next, it executes a step SE7 of incrementing the address register 7 by +1 to set address 2. Then it executes a step SE8 of supplying the time data T0 to the B input terminal group of the full adder 30. At this time, the full adder 30 which is now functioning as adder, adds the same time data T0 at its both input terminal groups. The result data T0 is latched in the NE latch 28 in a step SE9. The CPU then executes a step SE10 of checking if a coincidence signal of "1" is provided from the NOR gate 29. Since this "1" signal is provided, the routine returns to the step SE3. In the subsequent step SE4, data 01H read out from address 2 of the RAM 5 is supplied to the tone generating unit 3. The tone generating unit 3 thus sets the sustain effect 1DH to attach this effect to the tone information. As shown in FIG. 13, the time data between the data 01H and 1DH in the respective addresses 2 and 4 of the RAM 5 is T0, that is, the time interval between the two data is zero, so that they are regarded to be set simultaneously. Thus, the tone color TONE 0 and sustain effect are attached to the first tone C3 of the tone information, the sounding of which is started with the start of reproduction according to the music score of FIG. 7.

Through the steps SE5 and SE6 the time data T2 is read out from address 3 of the RAM 5. In the step SE7, address 4 of the RAM 5 is set. Through the subsequent steps SE8 and SE9 result data T2 is obtained by the full adder 30 adding the time data T0 and T2 which is then latched in the NE latch 28. The steps SE10 and SE11 are then repeated until the coincidence signal of "1" is detected in the step SE10. On the tone information side, the reproduction of the second tone E3 is executed after the reproduction of the first tone C3. The tone color and sustain effect of the respective data 01H and 1DH are also attached to the second tone data E3. When the reproduction of the second tone E3 is completed, the coincidence signal of "1" is detected in the step SE10. To the third tone G3 of the music the vibrato effect is attached in addition to the two effects noted above through the step SE10. Through the steps SE5 and SE6, the time data T2 is read out from address 5 of the RAM 5. Further, through the steps SE7, SE8 and SE9, address 6 of the RAM 5 is set, and result data T4 from the full adder 30 is latched in the NE latch 28. With the repetition of the steps SE3 through SE10 as described, the various musical effects are attached to the pertinent tones of the tone information according to the music score of FIG. 7.

The time data T0, T1, . . . shown in FIG. 4 and those shown in FIG. 13 are not equal in time length, that is, they are not based on the same time unit. More specifically, in the former time data for the tone information, the sum of the quarter note tone lengths is made T8, which is shared by the key-on and key-off times of T7 and T1. In the latter time data for the performance information, the time length of one quarter is made the unit of time length of attachment of musical effect. That is, when an effect is attached for the time length of one quarter note, it is represented as time data T1. Therefore, in order for the tone information and performance information to be reproduced simultaneously, the two independent address counters are provided in the address register and also the two identical circuits are provided in the recording and reproducing units 8 and 9 as noted earlier.

Although the music score of FIG. 7 has no indication of the pan-pot data, any such data is preset in the RAM 5 according to FIG. 10. Thus, during the reproduction it can be read out and supplied to the pan-pot control unit 4, thus providing pan-pot position to the pertinent sounded tones.

Referring back to FIG. 14, when the reset switch 1A is turned on during reproduction, this is detected in the step SE11 in a state of waiting for a coincidence signal of "1". This brings an end to the reproducing operation.

Now, the operation of the frequency divider noted above, which makes the operation of the up/down counter during the recording and reproduction variable, will be explained. Referring to FIG. 5A, when the normal switch FSW in the three-ganged lock switch is turned on, the other switches, i.e., the tempo acceleration switch CSW and slow tempo switch DSW, are "off". In this case, only the transfer gate 24 is thus enabled, and the transfer gates 23 and 25 are disabled. The output signal of the tempo oscillator 18 is thus frequency divided into one half by the flip-flop 21, to be supplied as a normal tempo clock to the up/down counter 17.

When the tempo acceleration switch $C_{SW}$ is turned on, the other switches $D_{SW}$ and $F_{SW}$ are both "off". Thus, the transfer gate 23 is enabled, and the other transfer gates 24 and 25 are disabled. The output of the tempo oscillator 18 is thus supplied as a clock to the up/down counter 17. The clock in this case has double the frequency than in the case of the normal tempo to permit fast feeding.

When the slow tempo switch DSW is turned on, the other switches CSW and FSW are both "off". The transfer gate 25 is thus enabled while the other transfer gates 23 and 24 are disabled. The output of the tempo oscillator 18 is thus frequency divided into one-fourth by the flip-flops 21 and 22 to be supplied to the up/-down counter 17. In this case, the recording and reproduction can be obtained in slow tempo, i.e., one half the normal tempo, which is effective particularly for reproduction for correction of information. Of course by turning on the tempo stop switch ESW, the AND gate 20 is closed to inhibit the input of a clock to the up/-down counter 17 and hence the recording and reproducing operations.

In the above embodiment, six different musical tone colors and musical effects are provided, but their kind and number may be suitably varied. As for the tone information and performance information memory, a single memory having three or more different memory areas may be used as well. In this case, the address counters may be provided in a corresponding number for independent operation for reproduction according to music. Further, the tone information and performance information may be stored in two or more independent memories.

As has been described in the foregoing, with the automatic music playing apparatus according to the invention, tone information indicative of musical notes or rests are first written and then performance information with respect to the tone information thus written is written, while listening to the reproduction thereof. Thus, the performance information indicative of tone colors and other musical effects can be entered very conveniently as compared to the prior art apparatus, and also the image of music as a whole can be grasped very easily while the performance information is written.

What is claimed is:

1. An automatic music playing apparatus, comprising:
first and second memory means;
storing means for storing tone information determinative of notes, durations and rests of a musical piece, in said first memory means;
reading means for automatically and continuously reading out said tone information stored in said first memory means;
automatic playing means for reproducing the notes, durations and rests of the musical piece automatically in accordance with said tone information read out by said reading means;
setting means for setting performance information determinative of tone colors and tone effects for the notes of the musical piece, together with time information, in said second memory means while notes stored in said first memory means are played selectively by said automatic playing means, wherein the performance information can be set as desired for the selected notes;
sound producing means coupled to said first and said second memory means for producing sounds automatically and continuously according to the tone information and the performance information read out from said first and said second memory means; and
changing means for changing at least one of the tone colors and tone effects of the sound to be produced by said sound producing means at a timing designated by said time information set in said second memory means.

2. The apparatus according to claim 1, wherein said playing means includes:
a reverse switch;
means for successively reading out the tone information stored in said first memory means in the reverse order to the storing order according to an "on" output of said reverse switch for playing automatically; and
means for correcting the tone information being played automatically into another tone information.

3. The apparatus according to claim 1, wherein said first and second memory means are respective memory areas of a single memory.

4. The apparatus according to claim 3, wherein said single memory is a random access memory, and said automatic playing means includes:
first address designating means for designating addresses in a first area of said random access memory and second address designating means for designating addresses in a second area of said random access memory;
means for generating successive tones of given pitches and tone durations according to tone information read out from addresses designated by said first address designating means; and
means for producing sound according to the output of said tone generating means.

5. The apparatus according to claim 1, which further comprises:
control means for reading out the tone information and performance information stored in said respective first and second memory means in an associated relation with respect to one another for playing music automatically.

6. The apparatus according to claim 5, wherein said playing means includes:
means for successively generating said tone information;
first address designating means for causing the generated tone information to be successively stored in said first memory means;
means for successively reading out said tone information from addresses designated by said first address designating means; and
means for generating tones corresponding to the read-out tone information.

7. An automatic music playing apparatus, comprising:
a central processing unit;
an address register connected to be controlled by said central processing unit;
memory means for storing tone information determinative of notes, durations and rests of a musical piece, and performance information determinative of tone colors and tone effects for the notes of the musical piece, from said central processing unit, the addresses of the memory means being designated by said address register;
a keyboard for supplying said tone information to said memory means under the control of said central processing unit;
input means for supplying said performance information together with time information to said memory means under the control of said central processing unit;
recording means for storing said tone information in said memory means in co-operation with said central processing unit;
reproducing means for reproducing tone signals according to the tone information stored in said memory means, said tone signals having the tone colors and tone effects determined by the performance information stored in said memory means; and
changing means for changing at least one of the tone colors and tone effects of the tone signals to be reproduced by said reproducing means, at a timing designated by said time information.

8. The apparatus according to claim 7, further comprising reading means for automatically and continuously reading out said tone information stored in said memory means, and said reproducing menas reproduces said tone signals according to the tone information read out from said memory means.

9. The apparatus according to claim 7, wherein said recording means includes:

a latch, to which time data provided from said central processing unit and time data provided from said reproducing means are selectively supplied; and a subtracter having a first input terminal, the output of said latch being supplied to said first input terminal, and a second input terminal, the time data from said central processing unit and reproducing means being selectively supplied to said second input terminal, for producing time data representing tone durations.

10. The apparatus according to claim 8, wherein said reproducing means includes:

tempo clock generating means;

an up/down counter for counting the tempo clock and providing an output supplied as time data to said recording means;

a full adder having a first input terminal, time data contained in tone information from said memory means being supplied to said first input terminal;

a latch for latching the output of said full adder; and means for supplying the output of said latch to a second input terminal of said full adder.

* * * * *